United States Patent [19]

Ostrowski

[11] 4,064,927

[45] Dec. 27, 1977

[54] STANDARDIZED INVESTMENT MOLD ASSEMBLY

[75] Inventor: Richard C. Ostrowski, Dunlap, Ill.

[73] Assignee: Caterpillar Tractor Co., Peoria, Ill.

[21] Appl. No.: 740,995

[22] Filed: Nov. 11, 1976

[51] Int. Cl.[2] ..... B22C 7/02

[52] U.S. Cl. ..... 164/244; 164/246; 164/249; 164/34

[58] Field of Search ..... 164/34, 35, 36, 235, 164/236, 244, 249, 246

[56] References Cited

U.S. PATENT DOCUMENTS

| | | | |
|---|---|---|---|
| 3,094,751 | 6/1963 | Horton | 164/36 |
| 3,177,537 | 4/1965 | Horton | 164/244 X |
| 3,186,041 | 6/1965 | Horton | 164/36 X |
| 3,344,842 | 10/1967 | Cameron | 164/236 |
| 3,520,350 | 7/1970 | Watts | 164/244 |
| 3,572,421 | 3/1971 | Mezey et al. | 164/244 X |
| 3,648,760 | 3/1972 | Cooper | 164/35 X |
| 3,830,285 | 8/1974 | Schrader, Jr. | 164/249 |
| 3,854,832 | 12/1974 | Cowper | 164/235 X |

*Primary Examiner*—Francis S. Husar
*Assistant Examiner*—Kuang Y. Lin
*Attorney, Agent, or Firm*—Wegner, Stellman, McCord, Wiles & Wood

[57] ABSTRACT

A mold assembly for casting articles by the investment molding process. The assembly may include a wax center sprue element through which extends a center support. First and second wax end sprue elements are mounted in spaced relationship on the center support by means of expendable supports embedded in the sprue elements. A wax riser element extends between the spaced end sprue elements and carries wax patterns of articles to be investment cast by means of the mold. An expendable riser support may be embedded in the wax riser element and secured at spaced portions thereof to the end sprue element supports. A plurality of such wax risers may be provided in circumferentially spaced relationship to the center support, each of which may carry wax patterns. The wax riser elements may be provided with longitudinal, outwardly opening parallel grooves with the wax patterns being secured to the riser elements in the grooves.

18 Claims, 4 Drawing Figures

STANDARDIZED INVESTMENT MOLD ASSEMBLY

BACKGROUND OF THE INVENTION

1. Field of the Invention

This invention relates to investment molding and in particular to the forming of mold assemblies for use in the investment molding process.

2. Description of the Prior Art

In the investment molding process, the article to be cast is first produced as a wax pattern. Conventionally, the pattern may be dipped in a ceramic slurry to form a ceramic shell around the wax pattern. Subsequently, the wax is removed from the set shell to leave a cavity accurately corresponding to the wax pattern which thereby defines the desired casting mold.

It is desirable to form a plurality of such molds in an assembly for mass production of the article.

As shown in U.S. Pat. No. 3,854,832, of Glenn Sherwin Cowper, which patent is owned by the assignee hereof, a handling rod may be utilized for supporting the pattern as during the coating process. It is conventional to build up the coating by repeated dipping thereof into a suitable coating slurry, such as a ceramic slurry. Sand may be applied to each coating before applying the next coating to build up body in the mold. Conventionally, up to ten such coatings may be applied to form the desired mold.

The molds are then dried and delivered to a suitable autoclave for melting the wax from the surrounding set ceramic coating. The molds are completed by a flash firing in a furnace at approximately 1800° F. which effects a curing thereof. The castings are then made in the mold cavities by introduction of suitable molten metal after preheating the cavities to a suitable temperature. Upon completion of the setting of the metal, the ceramic coating is vibrated to break it free from the metal casting and permit final treatment of the casting which may include blasting and salt solution treatment and removal of the gates as by grinding.

SUMMARY OF THE INVENTION

The present invention comprehends an improved investment mold assembly permitting the formation of a plurality of molds in extremely simple and economical manner.

More specifically, the invention comprehends an improved investment casting mold including a wax sprue forming means, an expendable reinforcing means embedded within the sprue forming means, and a plurality of wax patterns secured to the wax sprue forming means. The mold may be provided with a carrier extending through a main sprue element thereof. A pair of end sprue elements may be mounted to the carrier by means of a corresponding pair of expendable supports embedded in the end sprue elements. A wax riser element extends between the end sprue element and carries the wax patterns of the articles to be investment cast.

In the illustrated embodiment, the carrier comprises a center support with the end sprue elements including a center portion mounted to the center support by expendable end sprue element supports embedded in the end sprue elements. Extending outwardly from the center portion of the end sprue supports may be a plurality of radially projecting arm portions with a corresponding plurality of risers extending between aligned arms of the two end supports.

In the illustrated embodiment, the arms are equiangularly spaced to provide a balanced mold assembly for facilitated handling.

Each of the risers may have an expendable support embedded therein secured at spaced portions thereof to the end sprue element supports.

In the illustrated embodiment, the sprue element supports are formed of a suitable expendable material, such as a thermally decomposable synthetic resin. In one embodiment, the supports were formed of polyurethane synthetic resin.

Each of the risers may be provided with a plurality of longitudinal outwardly opening parallel grooves with the wax patterns being secured to the risers in the grooves for facilitated alignment.

As a result of the interfitted connection of the reinforcing expendable sprue element supports, an improved rigidified mold assembly is provided for facilitated handling in the mold forming process.

The investment mold assembly of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
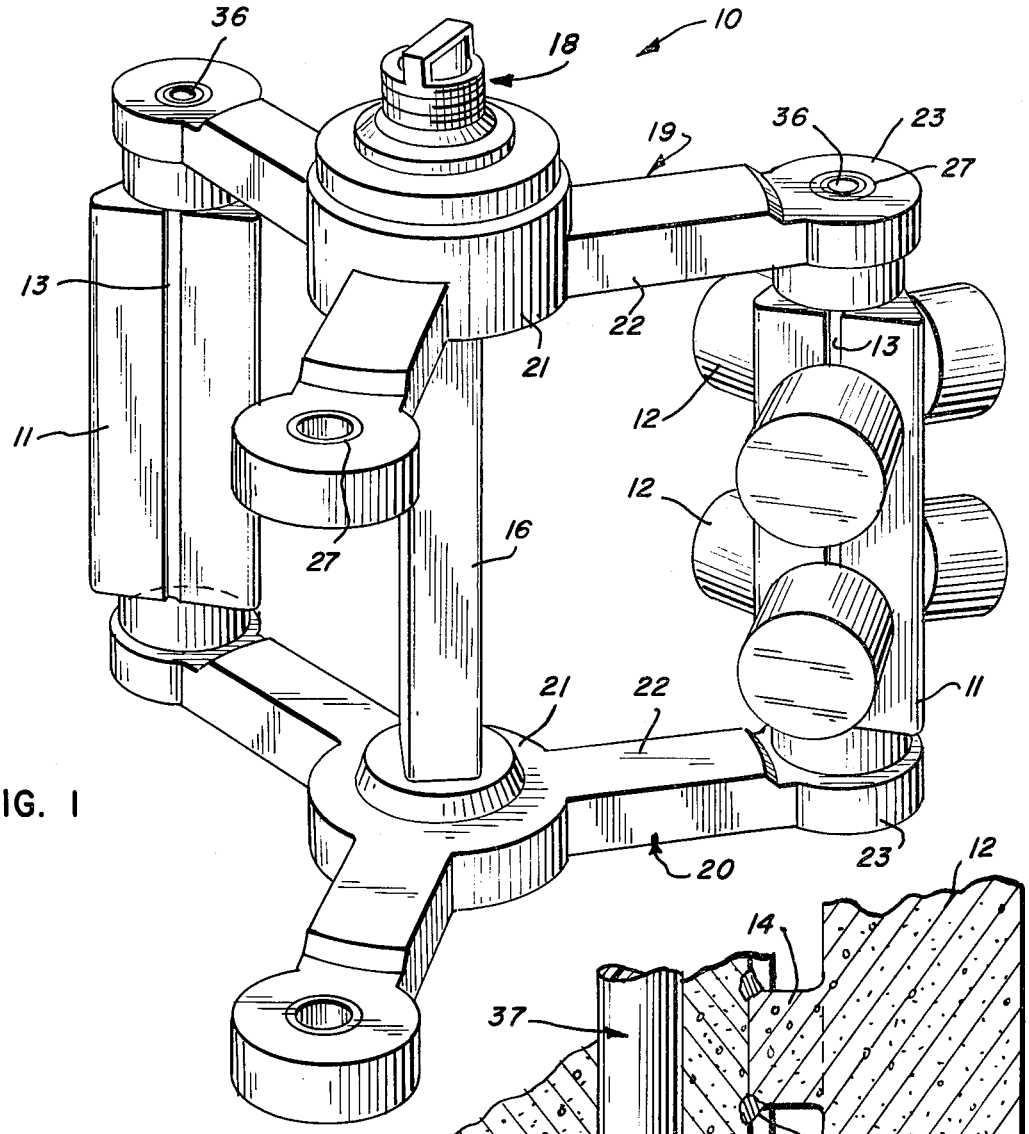
FIG. 1 is a perspective view of an investment mold assembly embodying the invention.

In the exemplary embodiment of the invention as disclosed in the drawing, an investment mold assembly generally designated 10 is shown to include a plurality of upright wax risers, or sprues, 11 carrying a plurality of wax patterns 12 of articles to be investment cast by means of the mold assembly. As shown in FIG. 1, the patterns 12 may be arranged in a preselected manner on the risers 11, and to facilitate such arrangement, the risers may be provided with vertical grooves 13 in which a mounting portion 14 of the respective patterns 12 may be secured as by wax weldments 15.

As further shown in FIG. 1, the mold assembly 10 further includes a main wax sprue element 16 through which extends a rigid carrier 17. The carrier may comprise a metal shaft, such as a steel tube, as illustrated in FIG. 3, and may include a connecting portion 18 at its upper end for use in carrying the mold assembly by suitable carrying means as during the mold forming operations.

The mold assembly further includes a pair of end sprue elements 19 and 20. In the illustrated embodiment, each of the end sprue elements includes a center portion 21 and a plurality of radiating arms 22, each terminating in a distal connecting portion 23. More specifically in the illustrated embodiment, each of the end sprue elements includes three arms equiangularly spaced about the axis of the carrier shaft 17. As will be obvious to those skilled in the art, any number of such arms may be utilized within the scope of the invention as a function of the size of the patterns 12. For facilitated manufacture and assembly, the end sprue elements are preferably symmetrical and, thus, may be useful as both the upper sprue element 19 and lower sprue element 20.

Figure 2:
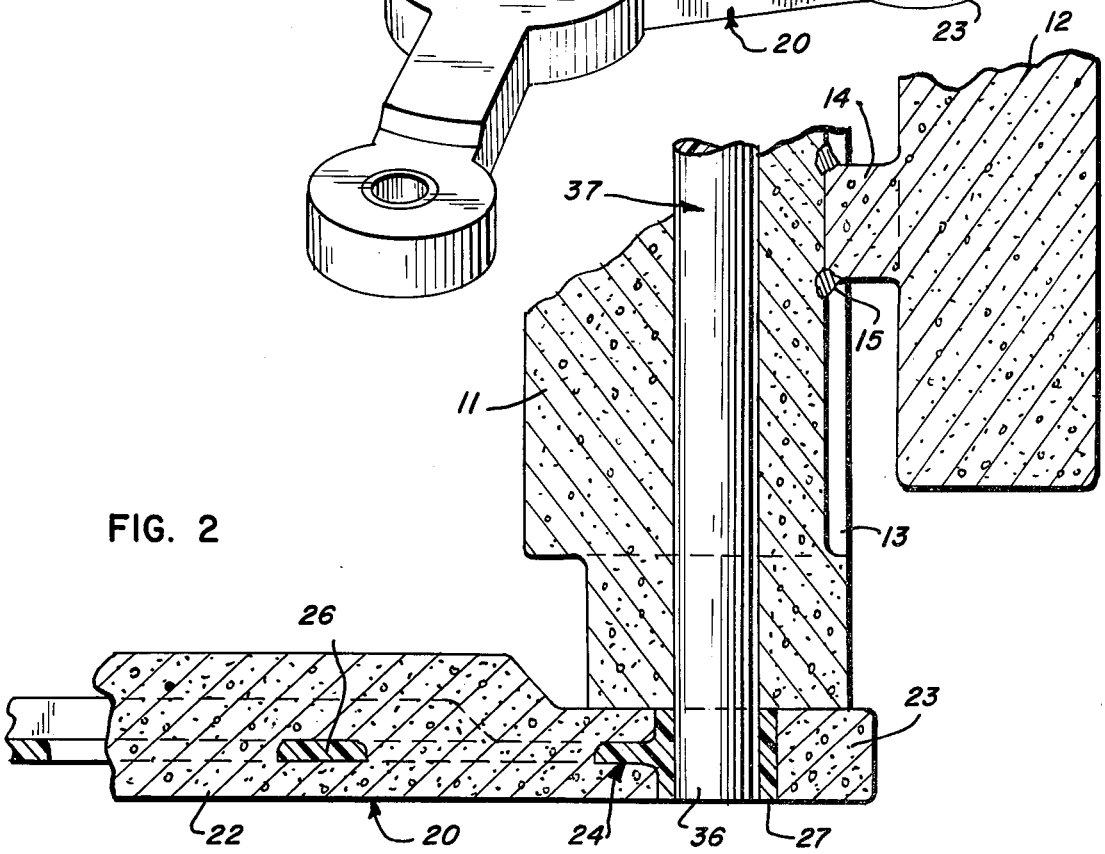
FIG. 2 is a fragmentary vertical sectional view of a portion thereof.
Figure 3:
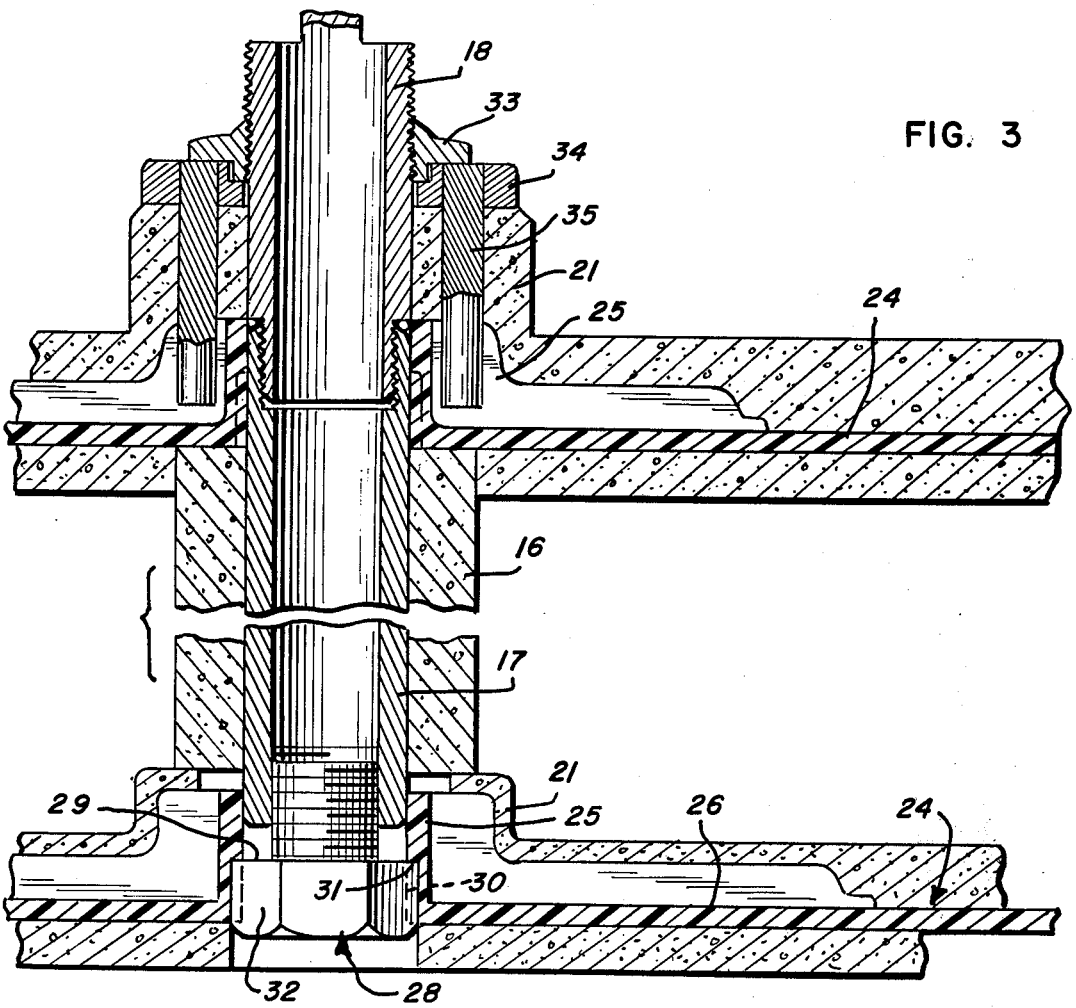
FIG. 3 is a fragmentary vertical section of the midportion of the mold assembly.

Each of the end sprue elements is provided with an internal expendable support 24 which, as illustrated in FIGS. 2 and 3, is effectively embedded in the end sprue elements to serve as a rigidifying means therefor. These supports may comprise a radiating arm structure corresponding to the configuration of the end sprue element and, thus, in the embodiment of FIGS. 1, 2 and 3, comprises a three-arm support having a center portion 25 and three radiating arms 26, each ending in a distal end portion 27.

As shown in FIG. 3, the lower end of carrier shaft 17 may be provided with a threaded element 28 defining an upwardly facing shoulder 29. Center portion 25 is provided with a plurality of spaced slots 30 defining a complementary shoulder 31 at the upper end thereof for engaging the shoulder 29 in positioning the lower support 24 in the assembly. As further shown in FIG. 3, the center portion 25 further embraces the head 32 of the threaded element 28 and the lower end of the tubular shaft 17 for centering the support coaxially of the shaft 17.

As further shown in FIG. 3, the center portion 21 of the end sprue elements extends into engagement with the main sprue element 16 and, thus, the main sprue element 16 effectively defines a center riser of the assembly and the end sprue elements effectively define radiating runners of the assembly.

Connecting portion 18 effectively comprises a mold support rod provided with a lock nut 33. An antispin washer 34 is juxtaposed to the lock nut 33 and is locked to the center portion 25 of the end sprue elements by suitable pins 35.

Figure 4:
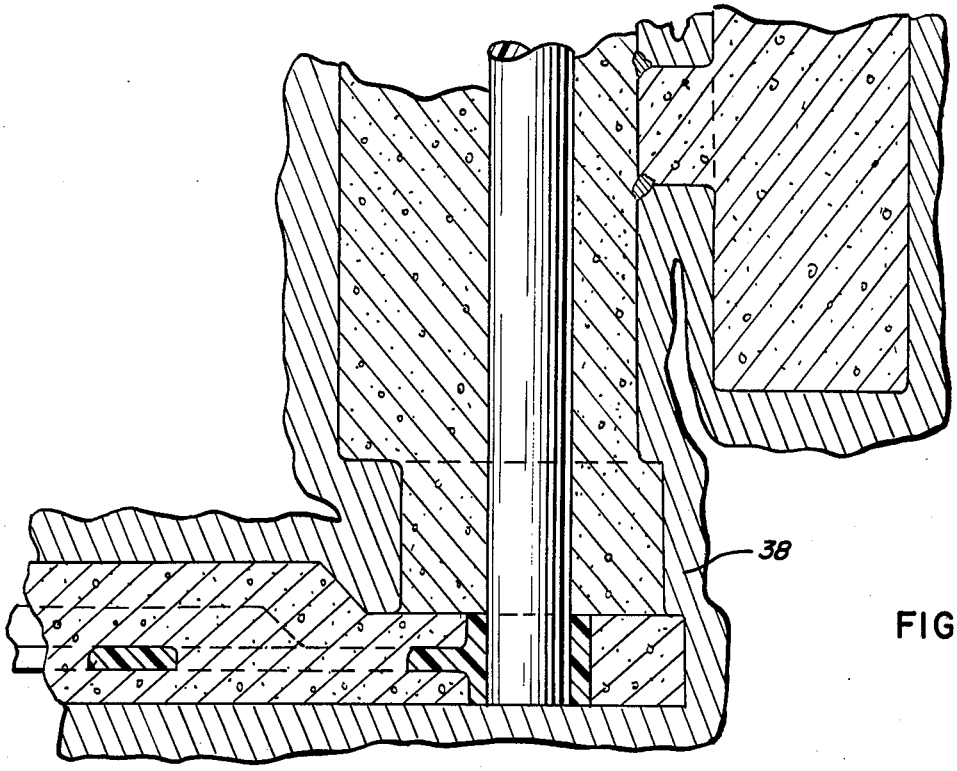
FIG. 4 is a fragmentary section similar to that of FIG. 2 but showing the ceramic coating formed about the pattern.

Referring now more specifically to FIG. 2, the end portions 27 of the support arms 26 comprise annular structures receiving an end portion 36 of a riser support 37 embedded in the riser 11. Ends 36 are fitted in the arm portions 27 so as to effectively interconnect the riser supports and the runner supports. In the illustrated embodiment, each of the supports 24 and 37 is formed of an expendable material which is thermally decomposable, but which, at normal ambient temperatures, is substantially stronger than the conventional wax materials utilized in such investment casting molds. Thus, the supports 24 and 37 comprise reinforcing means for providing a rigid assembly permitting the use of a relatively heavy structure whereby a substantial number of patterns may be concurrently formed while yet readily handled. More specifically, as shown in FIG. 4, upon completion of assembly of the mold, the mold may be dipped in suitable ceramic coating material so as to build up a coating 38 about the external wax configuration to define the desired pouring mold. The combined weight of the mold assembly and the coating thereon may be relatively large, and thus the present invention provides an improved arrangement permitting facilitated handling with minimum distortion or breaking of the mold during such coating and similar handling operations.

Upon completion of the forming of the mold coating 38, the wax and support materials are removed by suitable heating of the mold assembly. Illustratively, the coated molds may be heated in an autoclave to melt out the wax material and thermally decompose and remove the support material with the molds being flash fired at a temperature of approximately 1800° F. in a suitable furnace to complete the wax and support material removal and curing of the molds.

The connecting means 18 may then be removed and a suitable pouring funnel applied to the top of the completed mold permitting molten material to be delivered downwardly into the cavity defined by the removed wax and support materials. As indicated above, the cavity defined by the removed center support 16 wax material defines a downspout of relatively large size permitting the metal to be poured into the mold with minimum of turbulence. Thus, the metal may flow through the runner cavities defined by the removed support arms 19 and 20 to the vertical risers defined by the removed riser elements 11 and into the article cavities defined by the removed article patterns 12.

In the illustrated embodiment, the supports are formed of a suitable synthetic resin, such as polystyrene, polyurethane, etc. The use of the supports 24 permits the runner cross section to be relatively small while yet permitting the casting of a large number of articles in the mold assembly.

The use of the vertical grooves 13 in the riser elements 11 permits an automatic alignment of the patterns 12 on the risers for facilitated accurate assembly of the patterns in the mold assembly. Illustratively, mold assemblies corresponding to the disclosed assembly 10 have been utilized in defining only a single piece part per mold up to 1500 elements per mold with improved facility and ease of assembly.

The use of the rigidifying supports reduces the amount of wax required in the mold assembly and correspondingly reduces the amount of waste wax and waste metal and substantially simplifies the mold forming and casting operations.

Further, the improved simplified assembly substantially reduces the amount of labor required to form the desired mold assemblies. Approximately 50% of the entire labor content of the investment molding process is involved with the forming of the mold assemblies and, thus, a substantial saving in the entire cost of the molding operations may be readily effected by means of the present invention. Further, because a substantial number of patterns may be accurately and readily provided in each of the mold assemblies, the coating, casting, and postcasting cleaning and similar operations are simplified and the amount of labor therein is substantially reduced.

Each of the mold assemblies may be accurately controlled as to the height thereof by means of the mounting of the sprue supports 24 in accurate spaced relationship on the center carrier shaft. Thus, facilitated casting mechanization may be utilized.

The foregoing disclosure of specific embodiments is illustrative of the broad inventive concepts comprehended by the invention.

I claim:

1. An investment mold comprising:

a wax main sprue element;

a carrier extending through said main sprue element;

a first wax end sprue element;

a second wax end sprue element;

a first expendable end sprue element support embedded in said first end sprue element and having a mounting portion mounted to said carrier;

a second expendable end sprue element support embedded in said second end sprue element and having a mounting portion mounted to said carrier in spaced relationship to said first sprue element support whereby said end sprue elements extend laterally outwardly from said main sprue element in spaced relationship; and a wax riser element extending between said end sprue elements and carrying wax patterns of articles to be investment cast by means of said mold.

2. The investment mold of claim 1 wherein an expendable riser support is embedded in said riser and is secured at spaced portions thereof to said end sprue element supports.

3. The investment mold of claim 1 wherein a plurality of wax risers are provided in circumferentially spaced relationship about said main sprue element, each extending between said end sprue elements and carrying wax patterns of articles to be investment cast by means of said mold.

4. The investment mold of claim 3 wherein said end sprue elements define a center portion connected to said main sprue element, and radiating arm portions.

5. The investment mold of claim 3 wherein said end sprue elements define a center portion connected to said main sprue element, and equiangular spaced radiating arm portions.

6. The investment mold of claim 1 wherein said expendable sprue supports are formed of a thermally decomposable synthetic resin.

7. The investment mold of claim 1 wherein an expendable riser support formed of a decomposable synthetic resin is embedded in said riser and is secured at spaced portions thereof to said end sprue element supports.

8. The investment mold of claim 1 wherein said carrier comprises a metal shaft.

9. The investment mold of claim 1 wherein said riser element is provided with longitudinal outwardly opening parallel grooves and said wax patterns are secured to said riser element in said grooves.

10. The investment mold of claim 1 wherein said carrier defines spaced shoulders and said sprue element supports engage said shoulders to have accurate spaced relationship as determined by the spacing of said shoulders.

11. The investment mold of claim 1 wherein said carrier defines spaced shoulders and said end sprue element supports are secured against said shoulders to have accurate spaced relationship as determined by the spacing of said shoulders.

12. A rigidified investment casting wax mold comprising: a first wax sprue forming means; thermally decomposable reinforcing means embedded within said sprue forming means, the strength of the material forming said reinforcing means being substantially greater than that of the sprue forming wax at ambient temperatures thereby causing the reinforced sprue forming means to be rigid; a second wax sprue forming means; second thermally decomposable reinforcing means embedded within said second sprue forming means, said first and second reinforcing means defining interfitted connecting portions for causing the first and second sprue forming means to define a continuous sprue former; and a plurality of wax patterns secured directly to said first wax sprue forming means in substantially spaced relationship to said reinforcing means thereof.

13. The investment casting mold of claim 12 wherein said reinforcing means is formed of a synthetic resin.

14. The investment casting mold of claim 12 wherein said reinforcing means is formed of a polystyrene synthetic resin.

15. The investment casting mold of claim 12 further including a main sprue forming means connected to said second sprue forming means and having a removable metal support extending therethrough for use in carrying the mold.

16. The investment casting mold of claim 12 wherein said first and second sprue forming means comprise sprue forming elements retaining in connected association by said interfitted reinforcing means.

17. The investment casting mold of claim 16 wherein said wax sprue forming means comprise runner and riser elements.

18. The investment casting mold of claim 12 wherein said reinforcing means is formed of a polyurethane synthetic resin.

* * * * *

UNITED STATES PATENT AND TRADEMARK OFFICE

CERTIFICATE OF CORRECTION

PATENT NO. : 4,064,927

DATED : December 27, 1977

INVENTOR(S) : RICHARD C. OSTROWSKI

It is certified that error appears in the above-identified patent and that said Letters Patent are hereby corrected as shown below:

Column 5, line 43 (Claim 10, line 2), after "said" insert --end--.

Signed and Sealed this

*Fifteenth* Day of *January 1980*

[SEAL]

*Attest:*

SIDNEY A. DIAMOND

*Attesting Officer*

*Commissioner of Patents and Trademarks*